US009033197B2

(12) United States Patent
Bar

(10) Patent No.: US 9,033,197 B2
(45) Date of Patent: May 19, 2015

(54) SPOOL HOLDER

(76) Inventor: Nir Bar, Moshav Zafariya (IL)

( * ) Notice: Subject to any disclaimer, the term of this patent is extended or adjusted under 35 U.S.C. 154(b) by 460 days.

(21) Appl. No.: 13/002,694

(22) PCT Filed: Jul. 16, 2009

(86) PCT No.: PCT/IL2009/000703
§ 371 (c)(1),
(2), (4) Date: Jan. 5, 2011

(87) PCT Pub. No.: WO2010/007624
PCT Pub. Date: Jan. 21, 2010

(65) Prior Publication Data

US 2011/0108588 A1 May 12, 2011

Related U.S. Application Data

(60) Provisional application No. 61/129,771, filed on Jul. 17, 2008.

(51) Int. Cl.

| | |
|---|---|
| ***B65H 75/40*** | (2006.01) |
| ***A45F 5/02*** | (2006.01) |
| ***A45F 5/06*** | (2006.01) |
| ***B65H 35/00*** | (2006.01) |

(Continued)

(52) U.S. Cl.
CPC . *A45F 5/02* (2013.01); *A45F 5/021* (2013.01); *A45F 5/06* (2013.01); *A45F 2200/0566* (2013.01); *A45F 2200/0575* (2013.01); *B65H 35/0013* (2013.01); *B65H 49/205* (2013.01); *B65H 49/36* (2013.01); *B65H 2402/413* (2013.01); *B65H 2701/37* (2013.01)

(58) Field of Classification Search
CPC ..... A45F 5/02; A45F 5/021; A45F 5/06; A45F 2200/0566; A45F 2200/0575; B65H 35/0013; B65H 49/205; B65H 49/36; B65H 2701/37; B65H 2402/413
USPC ..... 224/666, 162, 667, 904, 660, 268, 269, 224/270; 225/65, 66, 78; 242/588.6, 597.3, 242/597.1
See application file for complete search history.

(56) References Cited

U.S. PATENT DOCUMENTS

| | | | | |
|---|---|---|---|---|
| 299,041 | A * | 5/1884 | Weeks | 242/597.3 |
| 1,262,005 | A * | 4/1918 | Bell | 242/379.2 |

(Continued)

FOREIGN PATENT DOCUMENTS

| | | | | |
|---|---|---|---|---|
| NL | 1019284 | | 5/2003 | |
| NL | 1019284 | C6 * | 5/2003 | 224/162 |

OTHER PUBLICATIONS

International Search Report and Written Opinion from International Application No. PCT/IL2009/000703.

*Primary Examiner* — Adam Waggenspack
*Assistant Examiner* — Matthew Theis
(74) *Attorney, Agent, or Firm* — Dorsey & Whitney LLP

(57) ABSTRACT

A spool holder and dispenser comprising a body fitted with a belt clip and two spool support arms extending from the body and defining between them a spool space, wherein at least one of said spool support arms is pivotal and spring biased towards said other spool support arm, and at least one of said spool support arms is fitted at its free end with a spool retention member; said spool support arms being displaceable between a retaining position wherein a tape is retained within the spool space, and a dispensing position wherein a tape is free to be discharged therefrom.

21 Claims, 10 Drawing Sheets

(51) Int. Cl.
*B65H 49/20* (2006.01)
*B65H 49/36* (2006.01)

(56) References Cited

U.S. PATENT DOCUMENTS

| | | | | | |
|---|---|---|---|---|---|
| 2,731,084 | A | * | 1/1956 | Burns | 225/65 |
| 2,944,749 | A | * | 7/1960 | Maier | 242/422.4 |
| 3,159,322 | A | * | 12/1964 | Martin | 225/56 |
| 3,477,656 | A | * | 11/1969 | Muller | 242/422.5 |
| 3,709,445 | A | * | 1/1973 | Adams | 242/596.2 |
| D227,823 | S | * | 7/1973 | Boyce | D3/228 |
| 3,799,466 | A | * | 3/1974 | Adams | 242/596.3 |
| 3,937,373 | A | | 2/1976 | Artz | |
| 4,130,229 | A | * | 12/1978 | Pagnini | 225/33 |
| 4,432,504 | A | * | 2/1984 | Pace | 242/598.1 |
| 4,606,485 | A | * | 8/1986 | Rankin | 225/78 |
| 5,100,037 | A | | 3/1992 | Kopyta et al. | |
| 5,549,255 | A | * | 8/1996 | Huang | 242/422.5 |
| 5,641,109 | A | | 6/1997 | Willoughby | |
| 6,095,455 | A | * | 8/2000 | Green | 242/588.1 |
| 6,216,978 | B1 | | 4/2001 | Rodriguez | |
| 6,497,352 | B2 | * | 12/2002 | Grover | 224/575 |
| 6,695,190 | B1 | * | 2/2004 | Gunter et al. | 225/47 |
| 7,861,904 | B1 | * | 1/2011 | Taylor et al. | 225/65 |
| 2005/0145344 | A1 | | 7/2005 | Mertins, Jr. et al. | |
| 2006/0237509 | A1 | | 10/2006 | Moore, Sr. | |

* cited by examiner

SPOOL HOLDER

CROSS-REFERENCE TO RELATED APPLICATIONS

This application is a U.S. Nationalization of PCT International Application No. PCT/IL2009/000703 filed 16 Jul. 2009, entitled "SPOOL HOLDER," which claims priority to United States Provisional Application No. 61/129,771 filed 17 Jul. 2008, the entireties of both of the foregoing applications are incorporated herein by reference.

FIELD OF THE INVENTION

This invention relates to spool holders of the type attachable to a belt or any kind of working platform. More particularly the present invention is concerned with a spool holder wherein the spool may be readily and easily attached/detached therefrom.

BACKGROUND OF THE INVENTION

Different professionals are often required to carry a tape or cord for performing certain tasks. Such professionals are fore example electricians (carrying electrically isolating tape), gaffers and other staff members in the show business (gaffer tape; often referred to in short as 'gaff tape'), painters (masking tape), plumber (guide wire/cord), police and rescue officers (barrier tapes), bandages, etc.

The need exists to rapidly obtain a spool of tape and apply whatever sort of tape is required and then rapidly and conveniently dispose of the spool such that it is readily available until the next time it is required, which may be very often.

For sake of convenience it is common to secure a tape spool or different tape dispensers to one's belt.

Hereinafter in the specification and claims any such tape material and cords mounted on a spool are collectively referred to as 'tapes'.

Different solutions have been disclosed for carrying and dispensing tape material therefrom, or for releasable carrying a tape spool. A most simple way of carrying a spool of tape is by a pouch mountable on a waste belt, as disclosed for example in U.S. Pat. Nos. 3,937,373 and 5,100,037.

Several arrangements are concerned with a so called utility belt formed with a variety of pouches and tool grips. One such solution is disclosed in US Patent Application 2006237509 directed to a utility belt for carrying at least one tool which is used in securing generally thin promotional sheet materials to a rigid structure includes an elongated member having a first end portion, a second end portion, a middle portion and a buckle connecting the first end portion and the second end portion together when the elongated member is worn around a waist of a user. An elongated strap has a pair of opposed ends each attached to the elongated member. A holder adapted for holding such at least one tool and having at least a semi-rigid shape is attached to the elongated strap or directly to the elongated member in one of a semi-permanent and permanent fashion.

Other arrangements are concerned with tape dispensers fixedly secured to a holder which in turn is belt-mounted. Such a device is disclosed for example in U.S. Pat. No. 5,641,109 directed to a belt-mountable tape dispenser operable with one hand for the retrieval and cutting of a predetermined length of tape from a spool of tape mounted to the dispenser. The tape dispenser includes a frame fabricated from a malleable material to accommodate conforming the frame to the waist of the wearer. Belt clips on each end of the frame releasably mount the frame to the belt. A strut extends downwardly from the frame and rotatably supports a reel upon which the spool of tape can be mounted. A cutter assembly and a cutter shield are removably attached to the strut. The cutter assembly and the cutter shield are adaptable to being mounted to the strut for either a left-hand operation or a right-hand operation. The placement of the reel below the frame prevents the pulling and tearing forces imposed on the tape from dislodging the tape dispenser from the belt.

Another arrangement is disclosed in U.S. Pat. No. 6,216,978 concerned with a compound tape dispensing device comprised of a belt attachment portion. A tape holding portion is secured to the belt attachment portion. A tape retaining portion is secured to the tape holding portion to hold a roll of compound tape thereon. An unwinding prevention portion is included to preclude the roll of compound tape from unrolling by applying pressure on a circumferential face of the roll of compound tape.

Other solutions offer a belt-mounted device for detachably carrying a tape spool. For example, US Patent Application 2005145344 discloses a tape dispenser system, apparatus, and method for dispensing strips of tape used for masking or tacking. The tape dispenser includes a frame, attachment/securement means, a quick release locking expandable tape hub expansion member mechanism for, removably securing a tape roll to the expandable tape hub, and a user preference adaptable tape cutter assemblage for easily accommodating left-handed and right-handed users. The cutter assembly of the invention includes at least one heavy duty blade for increased ease of cutting a plurality of types of tapes.

A 'spool' as referred to herein the specification and claims denotes any low-flanged or unflanged cylinder on which thread or tape material is wound for distribution and use.

A 'tape' as referred to herein the specification and claims denotes any type of narrow flexible strip, ribbon, band, string, wire and the like, wound over a spool, however without restriction to its shape, the material of which it is made of or its use.

SUMMARY OF THE INVENTION

The present invention is concerned with a spool holder of the type mountable on a belt or garment portion or on a suitable support surface, wherein the tape/cord with its spool is readily detachable and engageable therefrom.

The term spool holder as used herein the specification and claims is used to denote a holder for any type of spool for readily dispensing any sort of material, such as gaffer tape, masking tape, guide wires, cords, barrier tapes, bandages, and the like. Even more, the spool holder according to the present invention is useful for supporting other articles such as, headphones and other site tools.

According to the present invention there is provided a spool holder and dispenser comprising a body fitted with a belt clip and two spool support arms extending from the body and defining between them a spool space, wherein at least one of said spool support arms is pivotal and spring biased towards said other spool support arm, and at least one of said spool support arms is fitted at its free end with a spool retention member; said spool support arms being displaceable between a retaining position wherein a tape is retained within the spool space, and a dispensing position wherein a tape is free to be discharged therefrom.

Any one or more of the following features and design options may be incorporated with a spool holder according to the present invention:

the two spool support arms extend substantially parallel to one another.

the two spool support arms extend substantially perpendicular to a surface defined by the belt clip.

a gap extends between free ends of the spool support arms, said gap being narrower then the thickness of the tape's spool. This will prevent even an empty spool from falling.

the spool retention member is spaced from the body by a distance being at least the width of one spool.

the two spool support arms are spaced apart to bear at least the thickness of half a tape when mounted on the spool.

the belt clip is detachably attachable to a belt or garment portion.

the spool holder may comprise a tape cutter.

the tape cutter is articulated with one or both of the spool support arms.

the body is further fitted with an auxiliary attachment element for detachably attaching items thereto.

the auxiliary attachment element is a spring clip fastener.

the spool holder according to claim may be configured for holding two parallely disposed spools, each extending over a respective spool support arm.

the spool retention member is integral and fixed at the free end of a respective spool support arm.

the spool retention member is pivotally fitted at the free end of a respective spool support arm.

the spool retention member is spring biased to the free end of a respective spool support arm, so as to assume a normally closed, spool retaining position.

the spool support arms and retention member are manipulable into the dispensing position using one hand only.

a tape is introduced into the spool space by applying force against at least one of the spool support arms and the retention member so as to snap into the spool space.

one of the two spool support arms projects further out than the other spool support arm.

at least of the two spool support arms a respective spool retention member is formed with a guidance surface inclined so as to facilitate easy introducing of the tape into the spool space.

the at least one pivotal spool support arm is pivotally restricted so as to retain the spool space.

the gap between free ends of the spool support arms may be larger where at least the bottom spool support arm has an upwardly extending spool retention member suitable for constituting a barrier for the tape's spool.

the body of the spool holder may comprise an arrangement for attaching a glove holder. One example may be may be magnetic coupling of the gloves.

the belt clip may further comprise a fastener adapted for further securing of the spool holder to the belt.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION OF EMBODIMENTS

Figure 1:
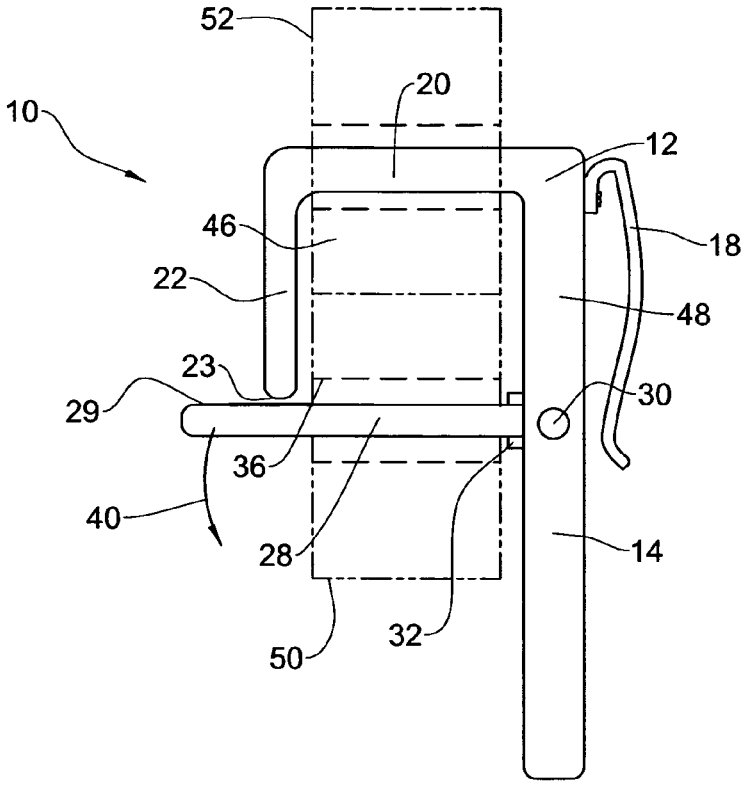
FIG. 1 is a side view of a spool holder in accordance with a first embodiment of the present invention.

Attention is first directed to FIG. 1 of the drawings illustrating a spool holder in accordance with the present invention generally designated 10 and comprising a body 12 made of rigid material (for that purpose any material would be suitable e.g. metal, plastic, etc.). The housing 12 has an inverted U-like shape with a downwardly extending leg portion 14 defining a rear surface 16 fitted with a belt clip 18 designed for mounting over a belt or other garment portion any kind of working platforms or hard mount assembly.

Integrally extending from the body there is a top spool support arm designated 20 formed at its free, front end with a spool retention member 22 in the form of an integral downward facing extension.

Pivotally secured to the body 12 there is a second spool support arm 28 pivoted to the body 12 at 30 and fitted with a coiled spring arrangement 32 (better seen in the similar embodiment of FIGS. 7A and 7B), however biasing the second spool support arm 28 in an upwards direction, namely towards the free end 23 of the spool retention member 22. As can be seen in FIG. 1, the second spool support arm 28 is fitted with a piece of felt or other soft material designated 36 whereby upon pivotal displacement of the second spool support arm 28 into its so-called open position (referred to also as the dispensing position) in direction of arrow 40 and releasing it, said felt 36 engages the free end 23 of the spool retention member 22 to prevent excessive noise.

The configuration of the spool holder 10 as illustrated in FIG. 1 gives rise to a spool space 46 defined between the first spool support arm 20 and the second spool support arm 28, and further by the respective rear portion 48 of the body 12 and the spool retention member 22.

In use, a tape (schematically illustrated by dashed lines and designated 50) is introduced over the second spool support arm 28 by pivotally displacing same in direction of arrow 40 and introducing the tape spool 50 into the position as illustrated. Alternatively, a spool may be introduced also in the position as illustrated by a dash-dotted line and designated 52 i.e. such that the spool of the tape 52 is mounted over the top, first spool support arm 20.

In use, the spool holder 10 is mounted for example on an individual's belt by the belt clip 18 and a tape of material is securely positioned as in accordance with either of the embodiments illustrated by tape spools 50 and 52, respectively, in the so-called retaining position of the device. When it is now required to release the tape from the holder 10, the lower, second spool support arm 28 is pivotally displaced in direction of arrow 40 (against the biasing force of coiled spring 32) thereby allowing the tape 50 to be easily released for immediate use. Mounting the tape back into its retained position is facilitated in a reverse sequence of operation namely by pivotal displacement of the second spool support arm 28 in direction of arrow 40 and introducing the tape spool into the spool holder, and then allowing the second spool support arm 28 to displace spontaneously into its normal position as in FIG. 1 (the so-called retaining position).

It is appreciated that manipulating the spool holder i.e. loading and unloading a tape therefrom, is radially and easily carried out merely by depressing the extending portion 29 of the second spool support arm 28 in direction of arrow 40 and this operation can be performed easily by a single finger e.g. thumb of the user also whilst being busy in performing other tasks, and even while wearing gloves.

Another embodiment is illustrated with reference to FIGS. 2A to 2C wherein like elements as in the previous embodiment are designated with like reference numbers, however shifted by 100.

The spool holder 110 has a rigid body 112 and generally has an L-like shape where a downwardly extending support portion 113 is fitted with a belt clip 118 and an integral top spool support arm 120. At a free end 121 of the top spool support arm 120 there is pivotally attached a spool retention member 122 pivotable in direction of arrow 123 (FIG. 2A). The spool retention member 122 may be spring biased into the normally closed position of FIG. 2A or it may assume its normally closed position merely under the effect of gravity. However, in order to prevent displacement of the spool retention member 122 from its vertical position of FIG. 2A in a clock-wise direction, the free end 121 is fitted with a downward extension 125, serving as a stopper member.

Figure 2A:
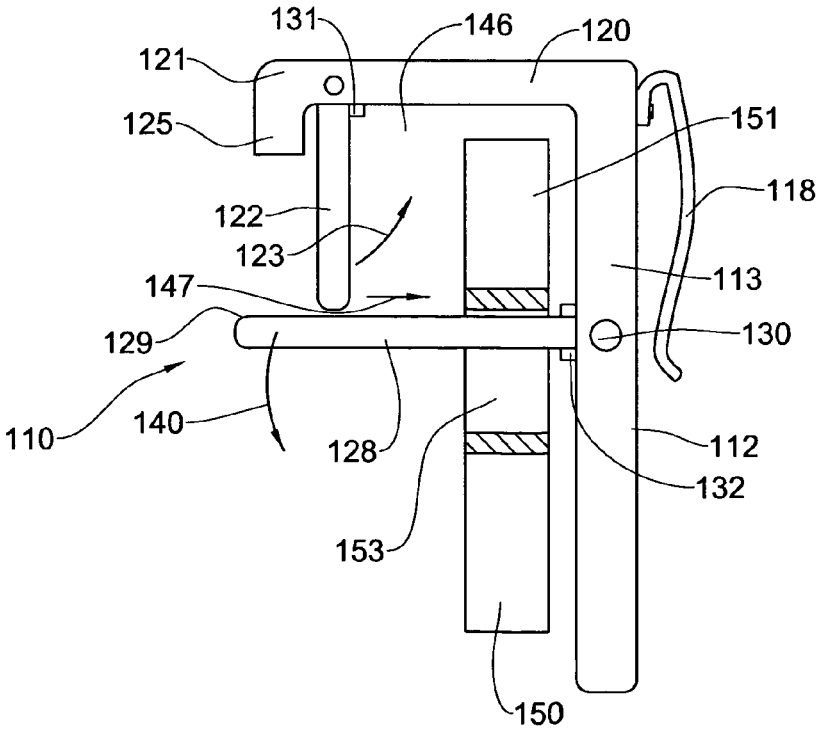
FIG. 2A is a side view of another embodiment of a spool holder in accordance with the present invention, with a tape spool held thereby.
Figure 2B:
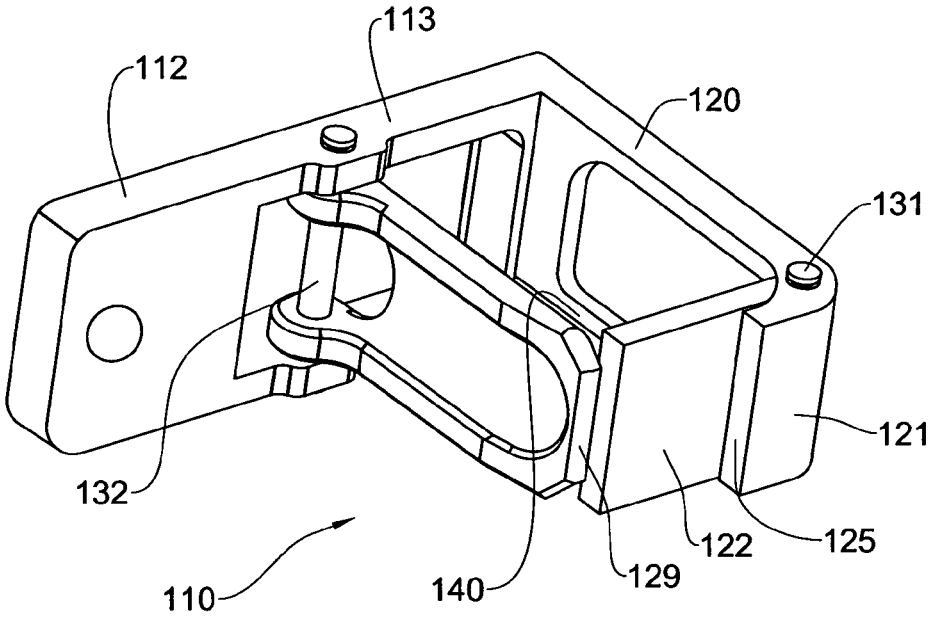
FIG. 2B is a bottom perspective view of the spool holder of FIG. 2A.
Figure 2C:
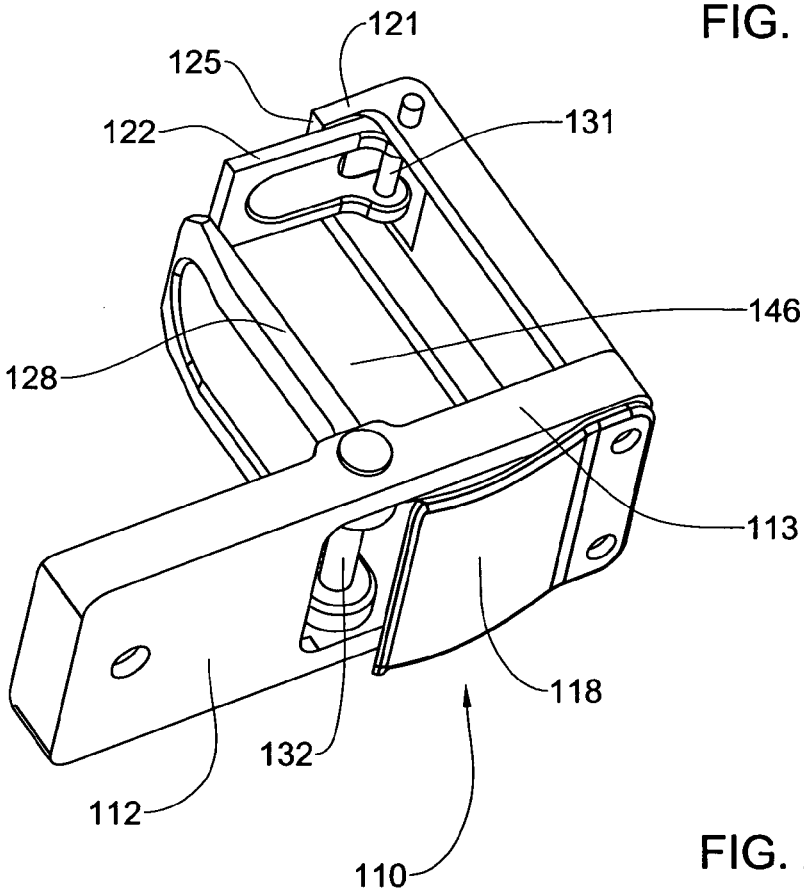
FIG. 2C is a rear perspective view of the spool holder of FIG. 2A.

A second spool support arm 128 is pivotally secured to the body at 112 at 130 and is fitted with a coiled spring 132 (best seen in FIGS. 2A and 2C), biasing the second support arm 128 into its normally closed position as illustrated in FIGS. 2Aa to 2C, namely substantially perpendicularly extending from the body portion 113, thus defining a spool space 146. It is appreciated that the second spool support arm 128 is normally biased into its spool retention position as illustrated in FIG. 2A and said arm is pivotally displaceable in direction of arrow 140 into the so-called spool dispensing position wherein a tape spool 150 mounted over the second spool support arm 128 is maintained such that a tape portion thereof 151 extends within the spool space 146. the biasing spring 132 is sufficiently strong to bear the self weight of the second spool support arm 128 and the load of a spool 151 mounted thereon.

A free end 129 of the second spool support arm 128 projects beyond the downwardly extending spool retention member 122 to facilitate easy grip thereof and easy deflection into the dispensing position against the biasing effect of the spring 132. Mounting a tape spool onto the device takes place by positioning the opening 153 of the spool 150 on the second spool support arm 128 and pushing it inwards in direction of arrow 147 against the biasing effect of the coiled spring 131 (retaining the spool retention member 122 in its downward, closed position) and allowing the spool retention member 122 to displace into its closed position under the biasing effect of spring 131 or under force of gravity.

Figure 3A:
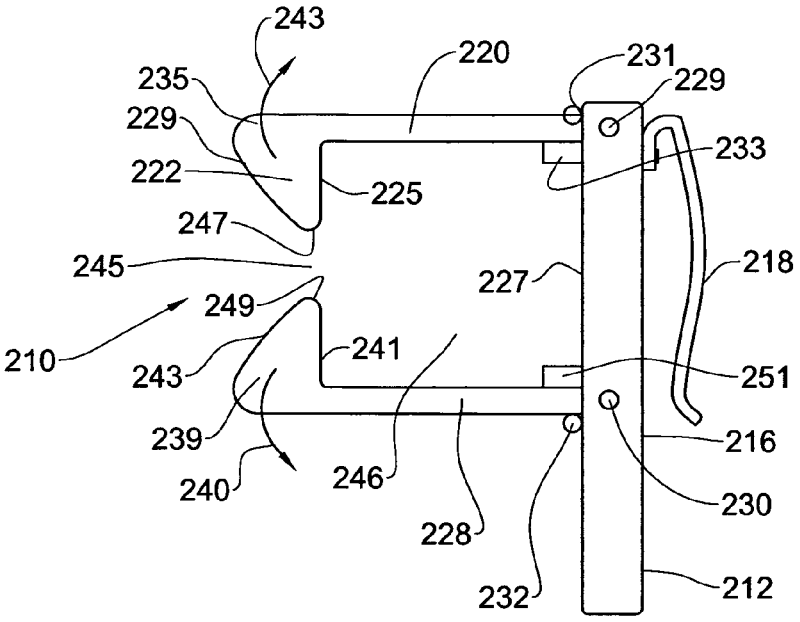
FIG. 3A is a side view of a spool holder in accordance with still an embodiment of the present invention.
Figure 3B:
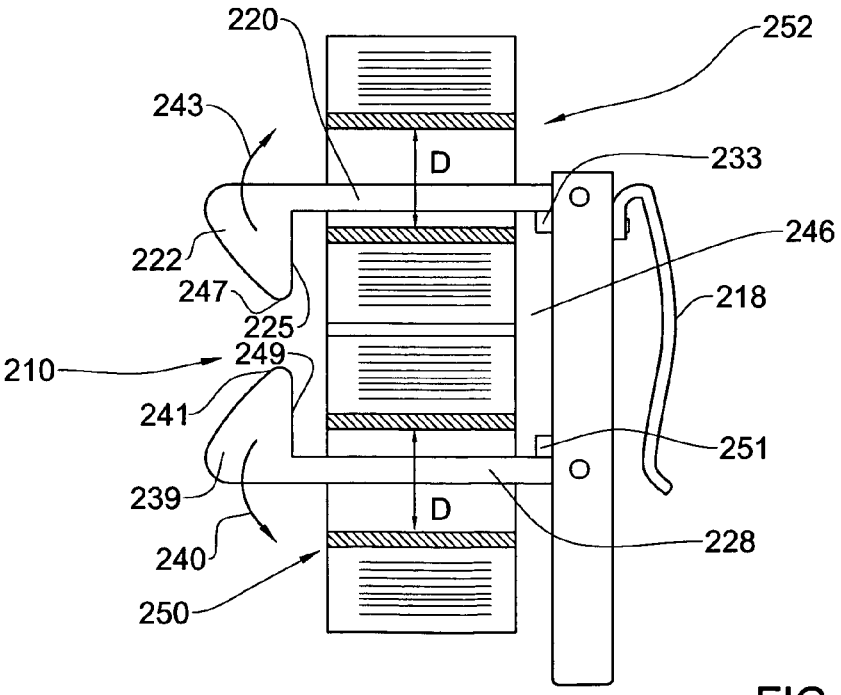
FIG. 3B illustrates the spool holder of FIG. 3A holding two tapes.

Turning now to the embodiment of FIGS. 3A and 3B there is illustrated a spool holder in accordance with a modification of the invention wherein like elements as in the embodiment of FIG. 1 have been designated with like reference numbers, however shifted by 200.

The spool holder 210 comprises a body 212 in the form of a flat bar substantially vertically extending and fitted at its rear surface 216 with a belt clip 218.

Laterally projecting 212 there is top spool support art 220 pivotally secured to the rear bar 216 at 229 and biased by a spring 231 into the spool retaining position, namely closed position, as illustrated in FIG. 3A. The top spool support arm 220 is prevented from downward pivotal displacement (i.e. beyond the substantially perpendicular position as in FIG. 3A) by virtue of the stopper element 233 extending from the rear bar 216. A free end 235 of the top spool support arm 220 is integrally fitted with a spool retention member 222 having a retention wall 225 which at the spool retention position of FIG. 3A extends substantially parallel to the front face 227 of the rear bar 216, and a front, inclined surface 229 (a so-called gliding surface) to facilitate easy loading of a spool tape into the spool space 246 as will be explained hereinafter.

A second spool support arm 228 is pivotally secured to the rear bar 216 at pivot point 230 and is pivotally biased by a coiled spring 232 into the normally closed position of FIG. 3A, namely the spool retention position.

Like the top spool retention arm 220, the bottom spool arm 232 is formed at its free end with a spool retention member 239 formed with a rear facing wall 241 at which at the spool retention position extends substantially perpendicular to the surface 227 of the rear bar 216, and further comprises a front inclined surface 243 to facilitate easy loading of a tape spool into the space 246 as will be discussed hereinafter. The second spool support arm 228 is prevented from pivotal displacement in a clock-wise direction beyond its substantially perpendicular position by means of stopper member 251.

A gap 245 extends between tip 247 of the top spool retention member 222 and tip 249 of the bottom spool retention member 239, respectively. The size of the gap 245 is designed so as to facilitate easy loading of a tape spool, and on the other hand, to retain a tape spool within the spool space 246, also when a tape is finished.

However, the gap between free ends (tips 247 and 249) of the spool support arms may be larger where at least the bottom spool support arm has an upwardly extending spool retention member 239, fitted with a retention wall 241, suitable for constituting a barrier for the tape's spool, such as illustrated in FIGS. 3A and 3B.

Loading a tape spool (FIG. 3B) into the spool space 246 is facilitated by introducing the spool's cavity over one of the two arms 220 or 228 against the biasing effect of coiled springs 231 and 232 allowing displacement of one or both of the arms in direction of arrows 240 and 243 respectively whereby upon positioning of the spool within the spool space 246 the arms spontaneously spring into their normally closed position, namely the spool retaining position.

Detaching a spool from the spool holder 210 takes place by displacing at least one of the spool support arms 220 and 228 in the respective directions of arrows 243 and 240 whereby the gap 245 is significantly enlarged to facilitate disengagement of the tape spool therefrom. It is appreciated that loading/unloading of a tape spool from the spool holder requires only one hand and wherein there is no need for fine movement such that also a person wearing gloves (e.g. working gloves) may easily facilitate loading/unloading of a tape.

FIG. 3B illustrates the spool holder 210 in accordance with the embodiment of FIG. 3A wherein a first tape 250 is mounted over the second spool support arm 228 and a second tape 252 is mounted over the first spool support arm 220, both retained within the spool space 246 and prevented from detaching by the vertically extending retention surfaces 225 and 241 of the spool retention members 222 and 239 respectively.

As mentioned hereinabove, detaching the top tape 252 is facilitated by displacing the first spool support arm 222 in direction of arrow 243 and detaching the second spool 250 is facilitated by pivotal displacement of the second spool support arm 228 in direction of arrow 240.

Furthermore, it is appreciated that the size of the spool retention members 222 and 238, namely the distance between the external surface of each arm and the respective tip 247 and 249 of a retention member, respectively, is smaller than the diameter D of the spools 250 and 252.

This arrangement facilitates retention of two different spools (which may be of identical or different widths and diameter) wherein each spool may be attached/detached from the device regardless of the presence/absence of the second tape.

Figure 4:
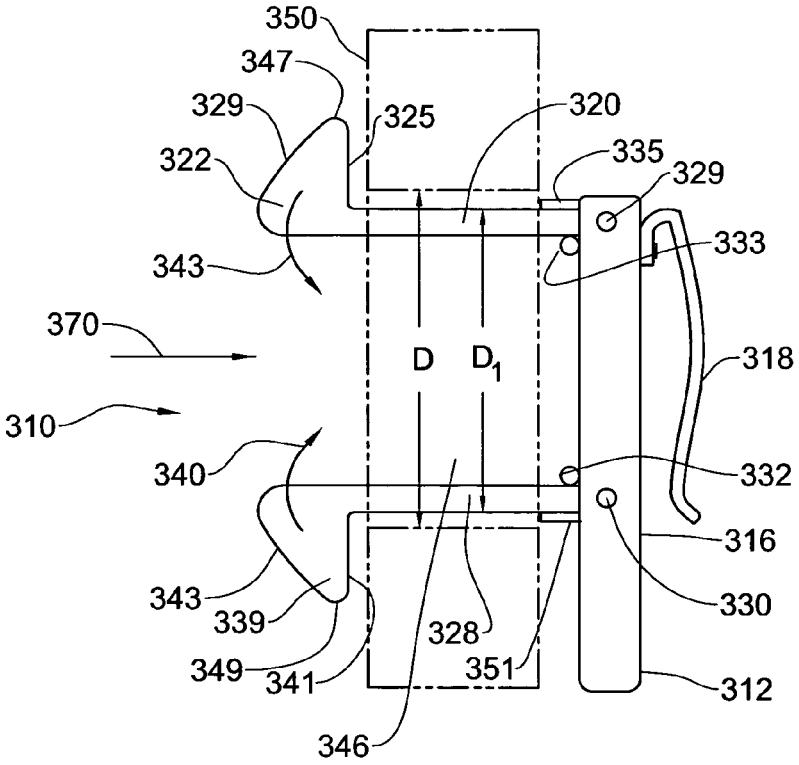
FIG. 4 is a side view of a spool holder according to yet an embodiment of the invention.

The embodiment illustrated in FIG. 4 resembles in a way the embodiment of FIGS. 3A and 3B and here again, like elements as in the embodiment of FIG. 1 are designated with like reference numbers, however shifted by 300.

The spool holder 310 comprises a body formed of a rear bar 312 formed at its back surface 316 with a belt clip 318.

A top spool support arm 320 is pivotally secured at 329 to the body 312 and is spring biased by a spring 333 into its normally tape retention position and is pivotal only in direction of arrow 343, however pivotally restricted by a stopper member 335 whereby the top spool support arm 320 is prevented from pivotal displacement in a clock-wise direction, beyond the position illustrated in FIG. 3B. A bottom spool support arm 328 is pivotally secured to the rear bar 312 at 330 and is normally biased into its substantially perpendicular position as in FIG. 3B by a biasing spring 332. The second spool support arm 328 is pivotal in direction of arrow 340, against the biasing effect of the coiled spring 332, however prevented from pivotal displacement in an opposite direction by means of the stopper member 351.

A spool space 346 extends between the top spool support arm 320 and the bottom spool support arm 328, and the respective portion of the rear bar 312.

The top spool support arm 320 is formed at its free, front end with a spool retention member 322 having a rear facing retention surface 325 which at the retention position as in FIG. 3B extends substantially parallel to the rear bar 316, and a front, inclined surface 329 to facilitate easy loading of a tape. Likewise, the bottom spool support arm 328 is fitted at its front end with a spool retention member 339 formed with a rearward facing spool retention surface 341 which at the retention position of FIG. 4 extends substantially parallel to the rear bar 312, and a front, inclined loading surface 343.

The spool holder 310 in accordance with the embodiment of FIG. 3B is suitable for retention of a tape 350 (illustrated by dashed lines) wherein the inside diameter D of the spool 350 is greater than the diameter D1 of the external surfaces of the spool support arms 320 and 328, respectively, however smaller than the distance L between the tips 347 and 349 of the spool retention members 322 and 339, respectively. However, at the dispensing, open position of the spool holder (not shown), the distance between the tips 347 and 349 of the spool retention members 322 and 339, respectively is smaller than the diameter D of the spool.

Mounting a tape spool on the spool holder 310 is facilitated by applying the cavity 353 of the tape 350 over the inclined surfaces ('gliding surfaces') 329 and 343 of the spool retention members, and applying a force in direction of arrow 370 against the biasing effect of coiled springs 333 and 332, causing the spool support arms 320 and 328 to pivotally displace in directions of arrows 343 and 340 respectively. The tape 350 is then displaced into the position shown in FIG. 3B allowing the support arms 320 and 328 to spontaneously displace under the biasing effect of the springs into the retention position of FIG. 3B, whereby the tape 350 will not disengage owing to the retention surfaces 325 and 341. Detaching the tape 350 from the spool holder 310 is facilitated by displacing the support arms 320 and 328 in pivotal motion of arrows 343 and 340, allowing for removal of the tape 350.

Figure 5:
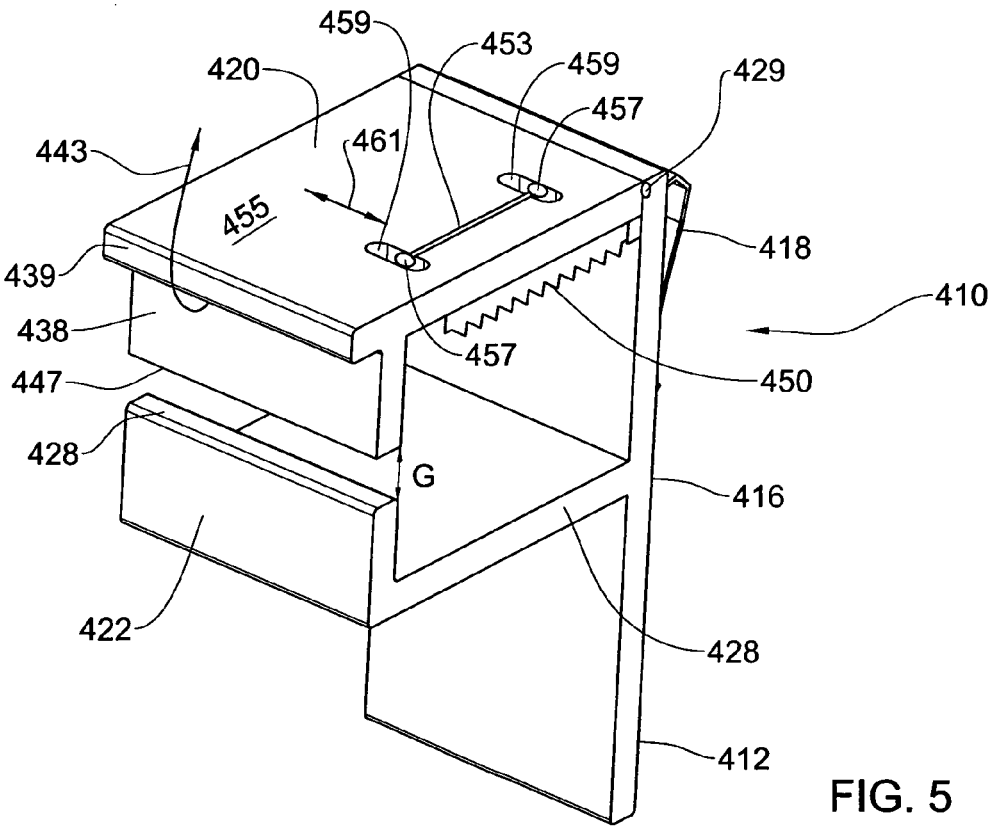
FIG. 5 is a perspective front view of a spool holder according to the present invention, fitted with a tape cutter.

With further reference to FIG. 5 of the drawings there is illustrated a modification of a spool holder in accordance with the present invention generally designated 400.

The spool holder 410 comprises a rigid body formed with a rear support portion 412 integrally formed with a bottom spool support arm 428 fitted at its front end with a spool retention member 422 projecting upwardly namely towards the top spool support arm 420.

Extending from the rear surface 416 of the body 412 there is a belt clip 418 similar to that disclosed in the previous embodiment.

The top spool support arm 420 is pivotally secured to the body 412 at pivot point 429 and is spring biased into its normally closed, tape retention position by means of a spring (not seen). A front, free end of the top spool support arm 420 is fitted with a spool retention member 438 downwardly projecting towards the spool retention member 422 of the bottom support arm 428. Furthermore, there is a laterally projecting gripping portion 439 extending from the top spool support arm 420 to facilitate easy gripping thereof and pivotal displacement in direction of arrow 443.

Loading/unloading of a tape onto the spool holder 410 in accordance with the embodiment of FIG. 5 is facilitated by pivotal displacement of the top spool support arm 420 in direction of arrow 443 whereupon the spool space 446 is expanded (namely expanding the gap designated G between the two tips 447 and 449 of the spool retention members 438 and 422, respectively).

An additional feature incorporated in the embodiment of FIG. 5 comprises a tape cutter in the form of a blade 450 secured to the top spool support arm 420 which in the present example is a serrated blade. The blade 450 may be fixedly attached to either or both the spool support arms 420 and 428, at either or both of their sides, and furthermore, the blade may be displaceable between a projecting position in which the blade may be utilized for cutting the tape and between a retracted position.

In the embodiment of FIG. 5 the top spool support arm 420 is fitted with a cutting blade 450 which is slideably displaceable by means of a manipulating bar 453 projecting on a top surface 455 of the top spool support arm 420, which bar 453 is associated with two projecting pins 457 integrated with the blade 450 and slideably retained within respective grooves 459 such that displacement of the manipulating bar 453 in direction of arrow 461 results in retraction or projection of the blade 450.

Figure 6A:
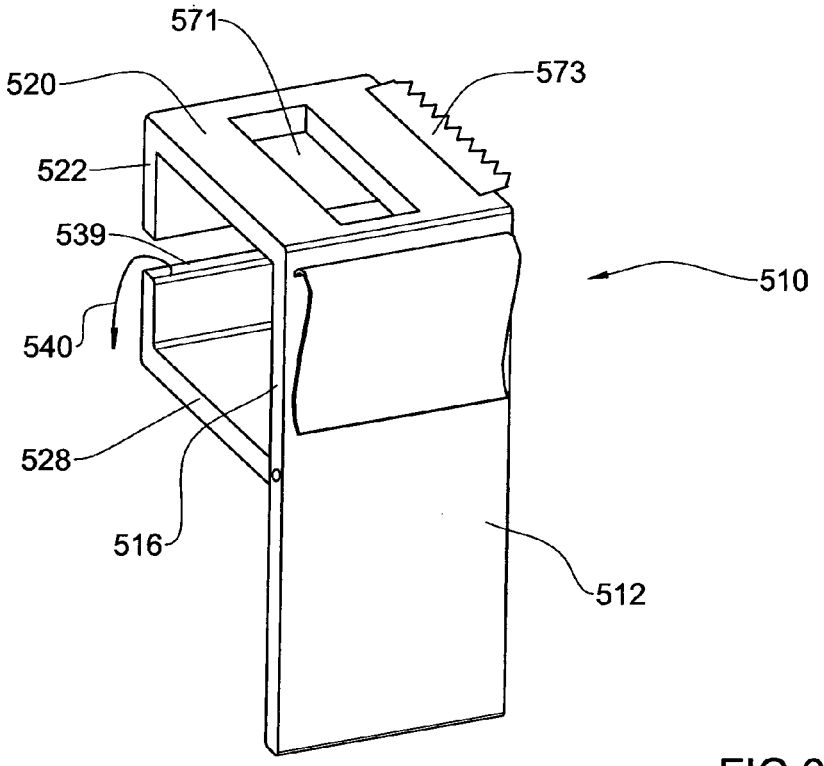
FIG. 6A is a rear perspective view of yet another embodiment of the invention, fitted with a tape cutter.
Figure 6B:
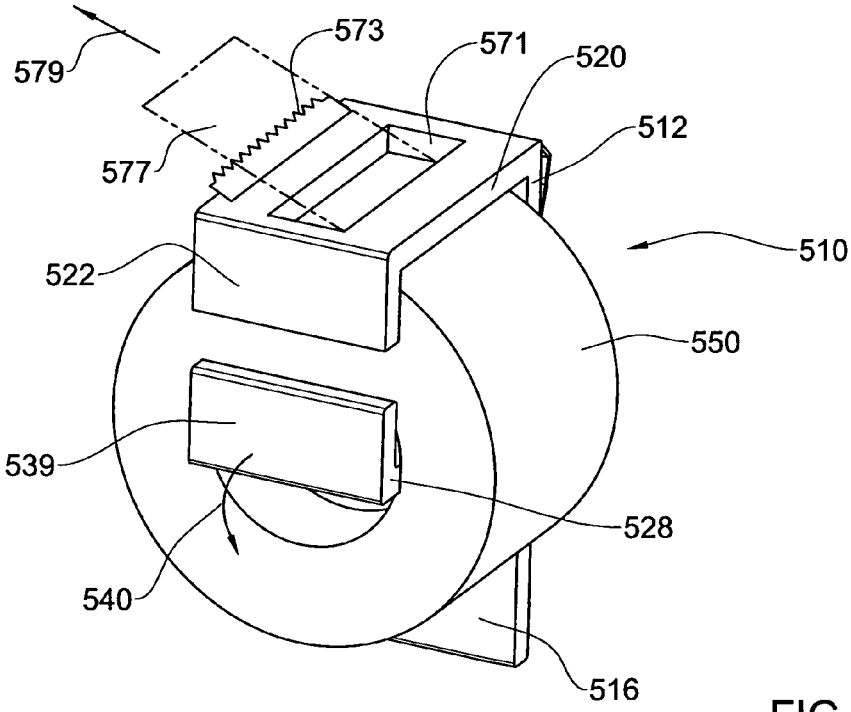
FIG. 6B is a front perspective view illustrating the spool holder of FIG. 5A however with a spool mounted thereon.

Turning now to the embodiment of FIGS. 6A and 6B there is illustrated a spool holder in accordance with still an embodiment of the present invention generally designated 510. In this embodiment the body 512 is integrally formed with a top spool support arm 520 which in turn is formed with a front spool retention member 522 downwardly projecting and integrated with the top spool support arm 520. A bottom spool support arm 528 is pivotally secured to the rear bar 516 of the body 512 and is pivotable in direction of arrow 540 between a substantially closed, spool retaining position as in the figures, and an open, dispensing position (not illustrated).

Integrally extending at a front end of the lower spool support arm 528 there is a spool retention member 539 facing towards the top retention member 522.

The embodiment of FIGS. 6A and 6B is similar in a way to the embodiment of FIG. 1 with the further addition of a tape dispensing aperture 571 formed in the top spool support arm 520 and further the provision of a tape blade 573 wherein a tape 550 (FIG. 6B) supported by the spool holder 510 may be easily attached/detached on the device and further, a tape 577 may extend through the dispensing aperture 571 and be easily cut at a required length after pulling in direction of arrow 579 as done with conventional tape dispensers.

Figure 7A:
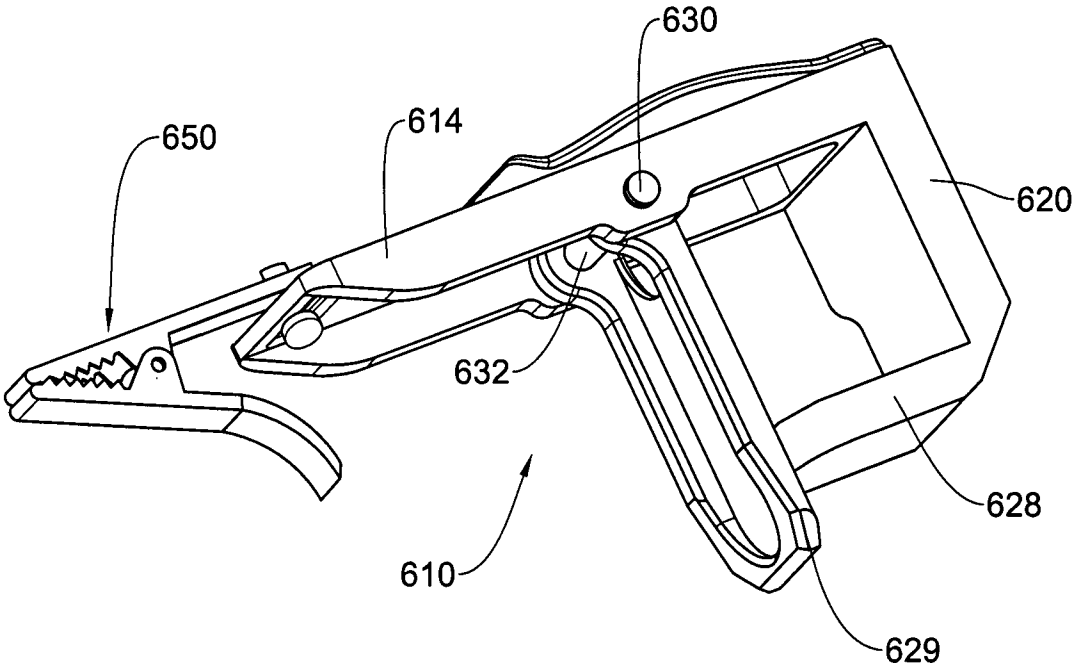
FIG. 7A is a top perspective view of a modification of the spool holder of FIG. 1.
Figure 7B:
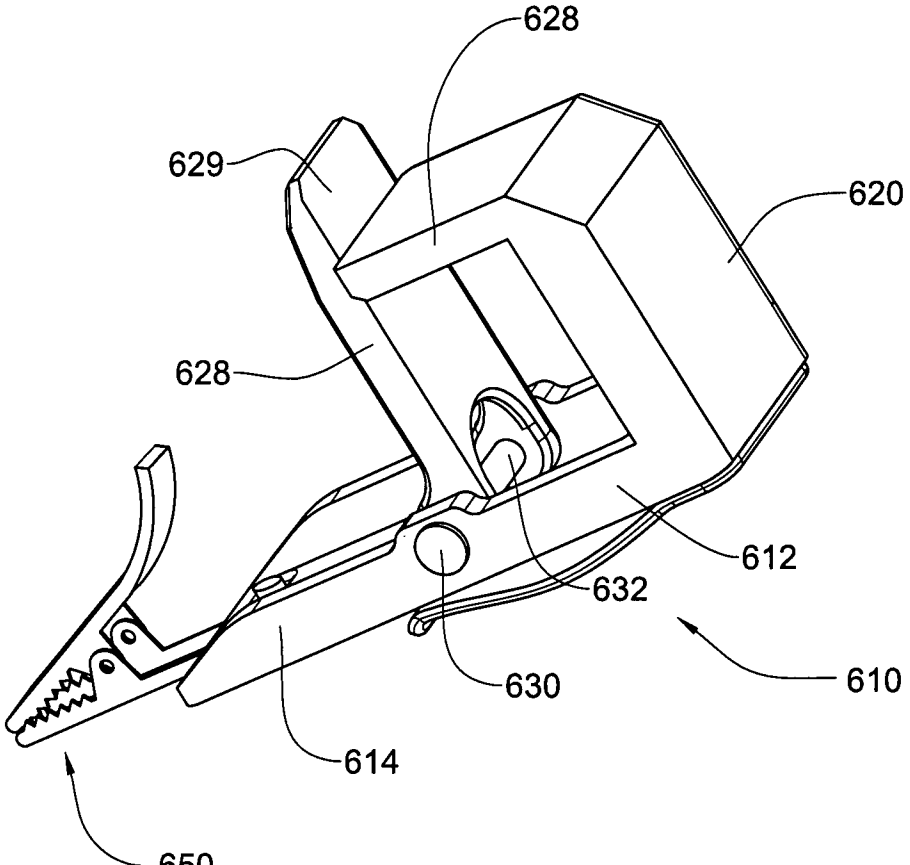
FIG. 7B is a bottom perspective view of the spool holder of FIG. 7A.

FIGS. 7A and 7B illustrate a spool holder in accordance with another embodiment of the present invention generally designated 610. The spool holder 610 is substantially similar to that disclosed in connection with the embodiment of FIG. 1 wherein a top spool support arm 620 is integrally and fixed with respect to the rear body portion 612, and a bottom spool support arm 628 is pivotable at 630 and is spring biased into its normally closed position by coiled spring 632. The bottom spool support arm 628 has a front end 629 projecting laterally in front of the spool retaining member 628 integrally formed at a front portion of the top spool support arm 620.

Figure 8:
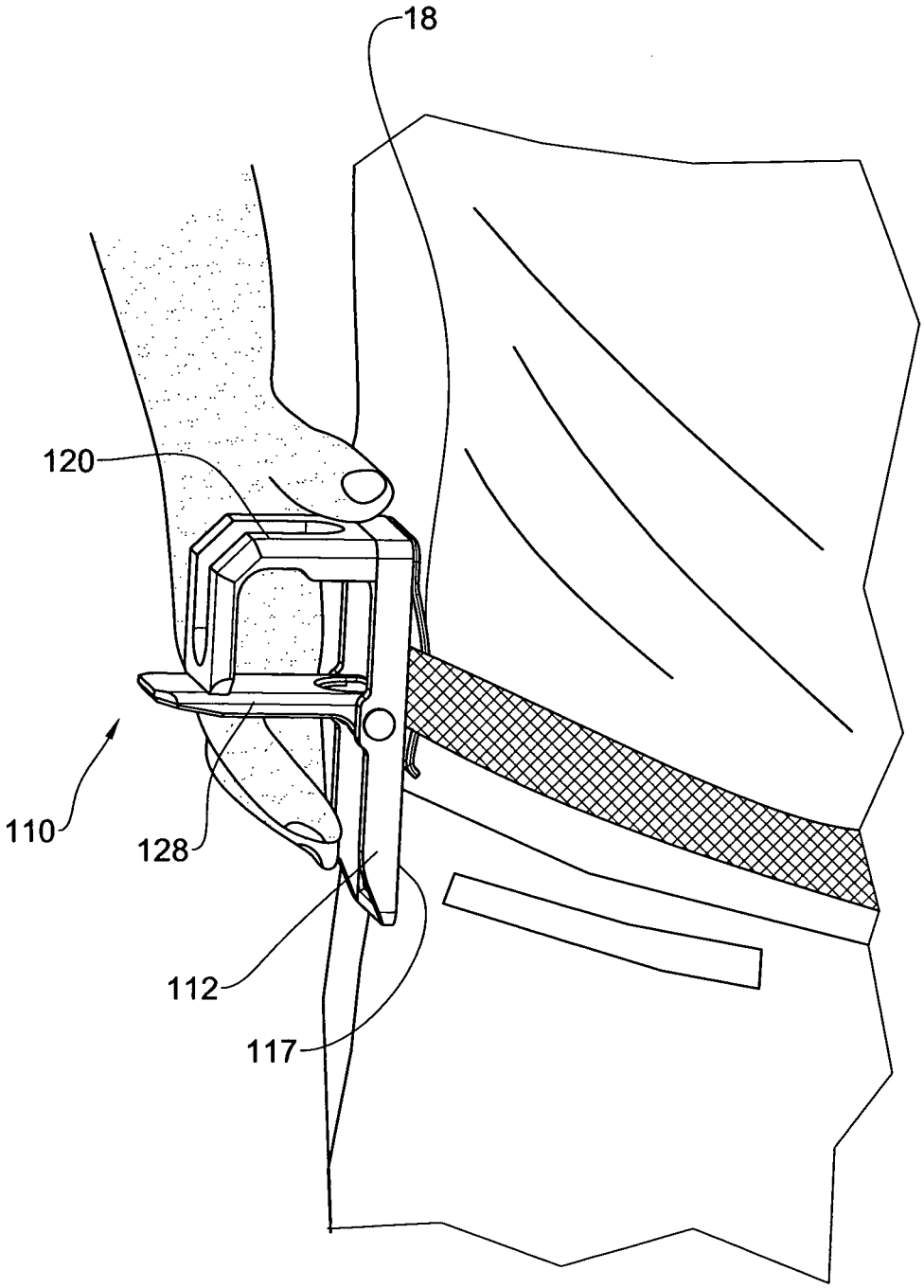
FIG. 8 illustrates the spool holder of FIGS. 1, 7A and 7B when mounted on a belt of an individual.

In addition, the spool holder 610 is fitted with an auxiliary attachment element 650 which in the present example is a crocodile-type clamp secured at the downwardly extending leg portion 614 of the housing 612 which attachment element 650 is suitable for securely attaching of different accessories e.g. working gloves, a cap and the like. Other types of such attachments may be a magnetic holder and the like. FIG. 8 illustrates a spool holder 110 of the type disclosed in connection with FIGS. 1,7A and 7B.

The spool holder 110 is illustrated in a position at which the rear surface 117 of the leg portion 112 extends against the user's waist by means of the belt clip 118 in a secure position, wherein a tape spool (not shown) may be easily attached/detached.

Figure 9A:
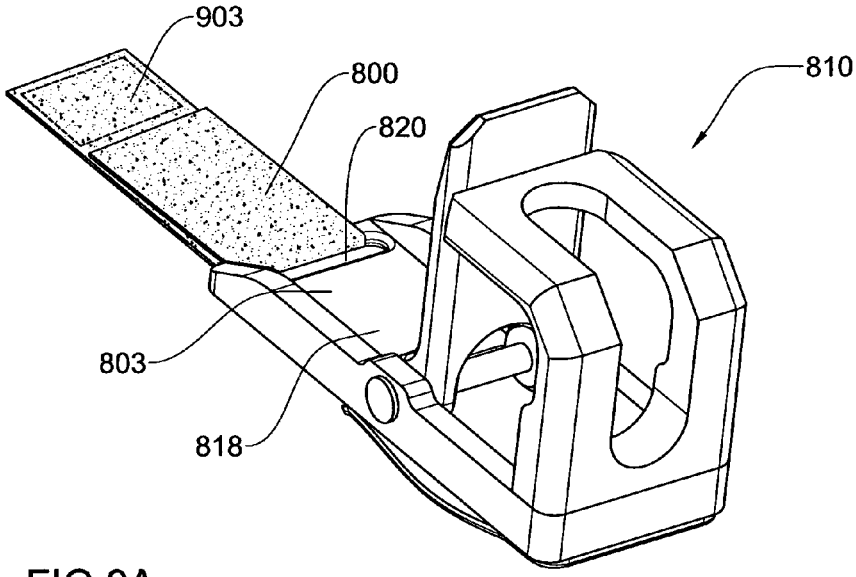
FIG. 9A is a top perspective view of a modification of the spool holder of FIGS. 1, 7A and 7B.
Figure 9B:
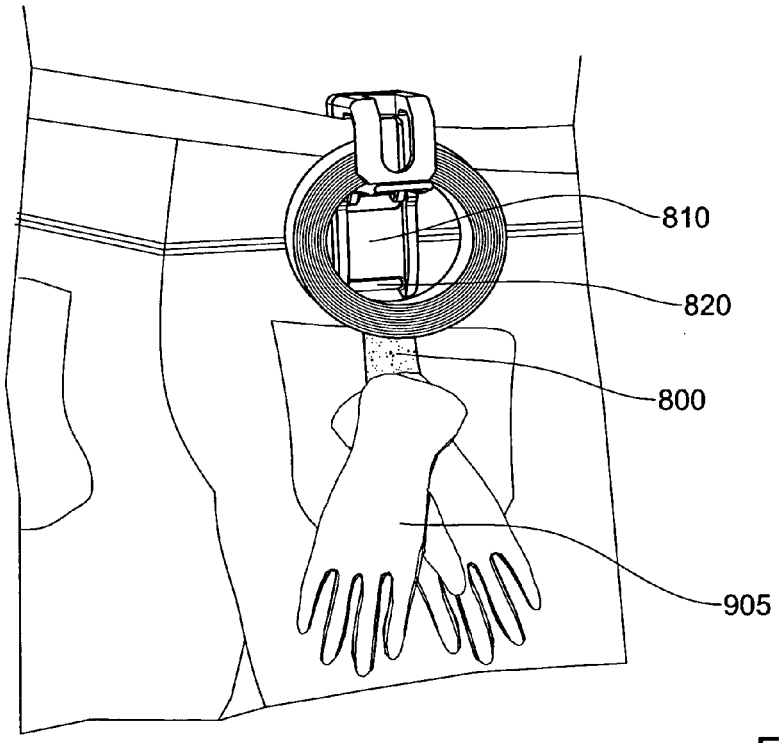
FIG. 9B illustrates the spool holder of FIGS. 1, 7A and 7B when mounted on a belt of an individual, with gloves attached thereto.

With reference to FIGS. 9A and 9B, a spool holder 810, similar to the spool holder 610 shown in FIGS. 1, 7A and 7B, may further comprise a slot 820 adjacent to an end 803 of its leg portion 818, adapted to receive therein a glove holder 900. The glove holder 900 is a Velcro™ strip, which may comprise a small magnet (not shown) within its end portion 903 adapted to magnetically couple gloves 905, as shown in FIG. 9B which also comprise small magnet therein, so that the gloves 905 may be easily secured on the spool holder 810 even with one hand.

Figure 10A:
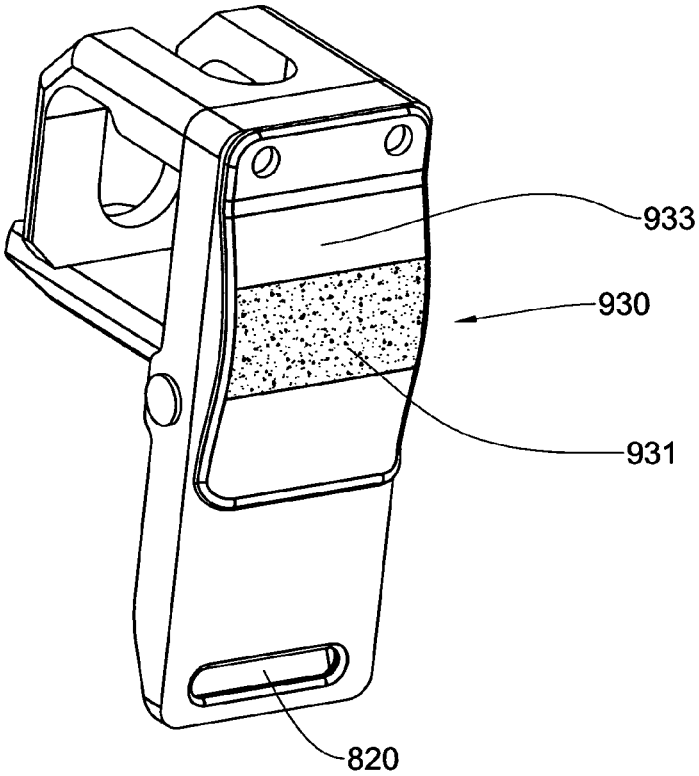
FIG. 10A is a rear perspective view of a further modification of the spool holder of FIGS. 1, 7A to 9B.
Figure 10B:
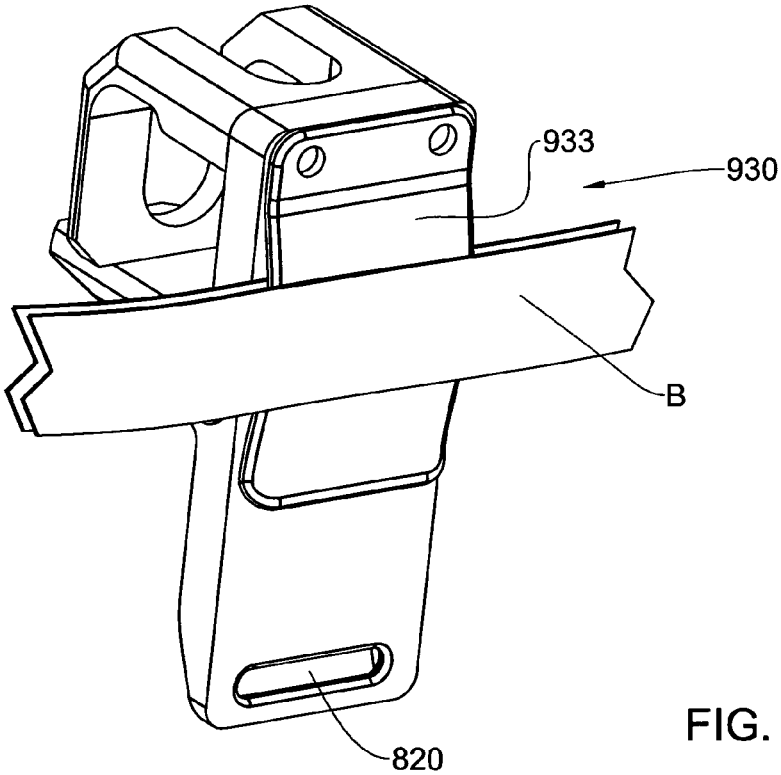
FIG. 10B is a rear perspective view of the spool holder shown in FIG. 10A when mounted on a belt of an individual.

With reference to FIGS. 10A and 10B, a spool holder 930, similar to the spool holders shown in FIGS. 1, 7A, 7B, 9A and 9B may further comprise a Velcro™ strip 931 attached to an outer face 933 thereof so as to be fastened to a corresponding fastener (not shown) within the belt B, providing thereby an additional securing of the spool holder to the belt.

Those skilled in the art to which this invention pertains will readily appreciate that numerous changes, variations, and modifications can be made without departing from the scope of the invention, Mutatis Mutandis.

The invention claimed is:

1. A spool holder and dispenser, comprising:

a body;

a belt clip fitted with the body; and two spool support arms extending from the body and defining a spool space therebetween;

wherein a first one of said two spool support arms includes a hinge mechanism having a pin and a spring combination configured to allow said first one of said two spool support arms to pivot and be spring biased towards a second one of said two spool support arm, and said second one of said two spool support arms is fitted at a free end thereof with a spool retention member;

said first one of said two spool support arms being displaceable between a retaining position wherein a tape is retained within the spool space, and a dispensing position wherein a tape is free to be discharged therefrom;

wherein said first one of said two spool support arms is disposed below said second one of said two spool support arms and only said first one of said two spool support arms is needed for supporting said tape to be retained within said spool space, and said spool retention member of said second one of said two spool support arms is positioned and configured to retain said tape on said first one of said two spool support arms when said tape is attempted to be displaced axially along said first one of said two spool support arms;

wherein said first one of said two spool support arms comprises a substantially flat portion configured to support said tape to be retained within said spool space; and wherein a gap extends between free ends of said two spool support arms in said retaining position so that said free ends are disposed in substantially close proximity with respect to each other.

2. The spool holder according to claim 1, wherein the two spool support arms extend substantially parallel to one another.

3. The spool holder according to claim 1, wherein the two spool support arms extend substantially perpendicular to a surface defined by the belt clip.

4. The spool holder according to claim 1, wherein a gap extends between free ends of the two spool support arms, said gap being narrower than a thickness of a spool of the tape.

5. The spool holder according to claim 1, wherein the spool retention member is spaced from the body by a distance being at least a width of one spool of the tape.

6. The spool holder according to claim 1, wherein the two spool support arms are spaced apart to bear at least a thickness of half a tape when mounted on a spool.

7. The spool holder according to claim 1, wherein the belt clip is detachably attachable to at least one of a belt or garment portion.

8. The spool holder according to claim 1, further comprising a tape cutter configured to cut the tape.

9. The spool holder according to claim 8, wherein the tape cutter is articulated with one or both of the two spool support arms.

10. The spool holder according to claim 1, wherein the body is further fitted with an auxiliary attachment element for detachably attaching items thereto.

11. The spool holder according to claim 10, wherein the auxiliary attachment element is a spring clip fastener.

12. The spool holder according to claim 1, configured for holding two substantially parallely disposed spools, each extending over a respective one of the two spool support arms.

13. The spool holder according to claim 1, wherein the spool retention member is integral and fixed at the free end of a respective one of the two spool support arms.

14. The spool holder according to claim 1, wherein the spool retention member is pivotally fitted at the free end of a respective one of the two spool support arms.

15. The spool holder according to claim 1, wherein the spool retention member is spring biased to the free end of a respective one of the two spool support arms, so as to assume a normally closed, spool retaining position.

16. The spool holder according to claim 1, wherein the two spool support arms and retention member are manipulable into the dispensing position using one hand only.

17. The spool holder according to claim 1, wherein a tape is introduced into the spool space by applying force against at least one of the two spool support arms and the retention member so as to snap into the spool space.

18. The spool holder according to claim 1, wherein one of the two spool support arms projects further out than another one of the two spool support arms.

19. The spool holder according to claim 1, wherein the spool retention member is formed with a guidance surface inclined so as to facilitate easy introducing of the tape into the spool space.

20. The spool holder according to claim 19, wherein the at least one pivotal spool support arm is pivotally restricted so as to retain the spool space.

21. The spool holder according to claim 1, wherein said tape is received by said first one of said two spool support arms.

* * * * *